US006147330A

United States Patent [19]

Ikeda et al.

[11] Patent Number: 6,147,330

[45] Date of Patent: Nov. 14, 2000

[54] PTC THERMISTOR ELEMENTS AND HEATING DEVICES INCORPORATING SAME

[75] Inventors: Yutaka Ikeda; Takashi Shikama; Yuichi Takaoka; Kenjiro Mihara, all of Shiga, Japan

[73] Assignee: Murata Manufacturing Co., Ltd., Kyoto, Japan

[21] Appl. No.: 09/260,622

[22] Filed: Mar. 1, 1999

[30] Foreign Application Priority Data

Mar. 2, 1998 [JP] Japan ..... 10-049213
Feb. 1, 1999 [JP] Japan ..... 11-023364

[51] Int. Cl.[7] ..... H05B 1/02

[52] U.S. Cl. ..... 219/505; 219/504; 219/552; 219/540; 338/22 R; 29/610.1

[58] Field of Search ..... 219/504, 505, 219/483, 540, 552, 553; 338/22 R, 22 SC; 29/610.1

[56] References Cited

U.S. PATENT DOCUMENTS 4,017,715 4/1977 Whitney et al. ..... 219/505
4,907,340 3/1990 Fang et al. ..... 219/505

*Primary Examiner*—Mark Paschall
*Attorney, Agent, or Firm*—Majestic, Parsons, Siebert & Hsue P.C.

[57] ABSTRACT

A PTC thermistor element for a heating device has a main body of a layered structure having a thinner layer and a thicker layer, sandwiched between electrodes formed on the main outer surfaces facing away from each other. The thinner layer has a thickness 0.05–0.43 times that of the thicker layer and is made of a PTC thermistor material with a Curie temperature which is lower than that of the thicker layer by 20° C. or more. The center of heat generation is thus shifted towards the electrode formed on the thinner layer, and a heating plate contacting it can be effectively heated.

25 Claims, 5 Drawing Sheets

PTC THERMISTOR ELEMENTS AND HEATING DEVICES INCORPORATING SAME

BACKGROUND OF THE INVENTION

This invention relates to positive temperature coefficient (PTC) thermistor elements and heating devices using such thermistor elements. In particular, this invention relates to improvements in their heating efficiency.

PTC thermistor elements are frequently used as a heat generator for a heating device, as shown, for example, in FIGS. 9 and 10. FIG. 9 shows a prior art PTC thermistor element 1 of a type comprising a main body 2 of a PTC material and a pair of electrodes (the first electrode 3 and the second electrode 4 ) formed on its mutually opposite main surfaces. A heating plate 5 to be heated thereby may be disposed, as shown in FIG. 9, so as to contact the first electrode 3, although it goes without saying that there may be situations where a heating plate can be disposed so as to contact both of the electrodes 3 and 4. FIG. 10 shows another prior art PTC thermistor element 6 of a type having a pair of comb-shaped electrodes 8 and 9 formed on one of main surfaces of a main body 7 made of a PTC thermistor material so as to interdigitally sandwich each other. A heating plate 10 to be heated thereby may be disposed so as to contact both of the comb-shaped electrodes 8 and 9.

Problems with such prior art thermistor elements 1 and 6 are explained next. With the PTC thermistor element 1 of the type shown in FIG. 9, heat escapes through the surfaces of the main body 2 and hence its surface temperature becomes lower than the temperature at the center. The temperature difference thus generated is shown in FIG. 12. As a result, the resistance of the main body 2 becomes higher at the center and hence the electric field intensity becomes higher there, while the field intensity becomes relatively weaker in the surface regions, as shown in FIG. 11. This causes an uneven heat distribution, the center part emitting more heat, giving rise to problems in heating efficiency and thermal response regarding the heating plate 5 to be heated thereby.

The standard thickness of the thermistor main body 2 is 2 mm or more, and this means that there is a distance of greater than about 1 mm between the center of heat production and the heating plate 5 to be heated. Since PTC thermistor materials are generally a poor thermal conductor, the temperature of the thermistor main body 2 remains higher near the center in the direction of its thickness and this has the effect of limiting the current which can flow inside. In summary, the heat generated by the thermistor main body 2 cannot be efficiently propagated to the heating plate 5 to be heated.

Attempts at preventing such lowering of heating efficiency have included increasing, as much as possible, the area of contact between the PTC thermistor element 1 and the heating plate 5, but this means that the overall size of the thermistor element 1 must necessarily be increased. If the overall size of the thermistor element 1 is increased, the heating device using the thermistor element 1 becomes correspondingly larger, and this is not a desirable consequence.

The lowering of heating efficiency can be reduced also by reducing the thickness of the thermistor main body 2 but the thermistor element 1 as a whole must generally satisfy an official requirement as to its thickness. Besides, this method cannot be adopted indiscriminately because the resistance against applied voltage should not be unduly compromised.

In a PTC thermistor element 6 of the type shown in FIG. 10, heat is generated mainly around the surface area where the electrodes 8 and 9 are formed, and hence the center of heat generation can be brought closer to the heating plate 10. In other words, heat can be more efficiently propagated to the heating plate 10 than by the thermistor element 1 of the type having electrodes on two mutually opposite main surfaces. On the main surface of the thermistor element 6 facing the heating plate 10, however, it is only the area where neither of the electrodes 8 and 9 is formed that can emit heat because the areas on which the electrodes 8 and 9 are formed do not emit heat. In general, the heat-emitting portion of the main surface facing the heating plate 10 is only from ½ to ⅔ of the main surface area. Moreover, since the electrodes 8 and 9 protrude outward from the main surface towards the heating plate 10, there is a space created between the heat-generating portion of the main surface and the heating plate 10. Such a space serves as a thermal resistance, adversely affecting the heating efficiency.

SUMMARY OF THE INVENTION

It is therefore an object of this invention in view of the above to provide a PTC thermistor element with which the problems as described above can be overcome.

PTC thermistor elements embodying this invention, with which the above and other objects can be accomplished, may be described generally as having a main body with a pair of main surfaces (the "first main surface" and the "second main surface") each having an electrode formed thereon and facing mutually oppositely away from each other, and may be characterized wherein the main body is of a layered structure with a plurality of layers extending parallel to the main surfaces and wherein a surface layer (the "first layer") including one of the main surfaces (the "first main surface") is made of a PTC thermistor material such that, when a voltage difference has been applied between the electrodes for a specified length of time, it will be across this layer (the "first layer") that a largest fraction of this applied voltage difference will appear, that is, the voltage difference which appears across the first layer will be the largest among the voltage differences which appear across the plurality of layers of the main thermistor body between the electrodes. If such a PTC thermistor material is used for the first layer, as explained above, this has the effect of shifting the center of heat generation inside the thermistor main body towards the first main surface. Thus, if a heating device is formed with such a PTC thermistor element, a heating plate to be heated thereby is placed opposite the electrode on the first main surface such that it can be heated quickly and efficiently. The temperature self-control function of the thermistor material can thus be utilized more effectively. If each of the plurality of layers of the thermistor main body is made of a PTC thermistor material, the condition stated above can be satisfied by forming the first layer with a material having the lowest Curie temperature. In other words, a thermistor main body according to this embodiment of the invention can be easily formed.

According to one of preferred embodiments of the invention, the main body is made of PTC thermistor materials forming two layers, both extending parallel to the main surfaces and each including one of them, and one of the layers has a thickness 0.05–0.43 times that of the other layer and a Curie temperature which is lower than that of the other layer by 20° C. or more. In this embodiment, it is preferred that the thinner layer have a lower resistance value than the other layer immediately after a voltage difference is applied between the electrodes. If the resistance values of the layers are thus selected, immediately after a voltage difference is applied between the electrodes, a larger fraction of it appears across the thicker layer. Thus, the thinner layer, although weaker in resistance against applied voltages, is better protected.

According to another preferred embodiment of the invention, the main body is of PTC thermistor materials and consists of at least three layers (that is, two outer layers and one or more inner layers therebetween), all extending parallel to the main surfaces, at least one of the outer layers having a thickness 0.05–0.43 times that of the inner layer or layers and at least one of the outer layers having a Curie temperature lower than that of the inner layer or layers by more than 20° C. According to this embodiment, too, the center of heat generation inside the main body is shifted towards one of the main surfaces. In this embodiment, it is further preferred that the materials of the layers be so chosen that at least one of the two outer layers has a lower resistance value than the inner layer or layers immediately after a voltage difference is applied between the electrodes. If the materials are so selected, as explained above, the thinner outer layer with a weaker resistance against applied voltage difference is protected by the thicker inner layer or layers with a stronger resistance against the voltage difference. In this embodiment of the invention, it is further preferable that the materials for the main body be selected such that the resistance values of the outer layers are each lower than that of the inner layer or layers.

If one of the outer layers is made of a PTC thermistor material having the lowest Curie temperature among the layers of the main body and is the thinnest among these layers, the center of heat generation inside the main body is shifted to a point close to the electrode thereon. If both of the outer layers are made of such a PTC thermistor material and are made thinner than the inner layer or layers, a center of heat generation can be formed closer to each of the electrodes. If each of the layers is made of a PTC thermistor material and materials having different Curie temperatures are used, layers made of materials with high Curie temperatures can prevent a thermorunaway which may be caused, say, by an inadvertent application of an excessively large voltage difference across the electrodes, in a layer with a lower Curie temperature.

BRIEF DESCRIPTION OF THE DRAWINGS

The accompanying drawings, which are incorporated in and form a part of this specification, illustrate embodiments of the invention and, together with the description, serve to explain the principles of the invention. In the drawings:

FIG. 8D is a diagonal view of the elastic member of FIG. 8C;

DETAILED DESCRIPTION OF THE INVENTION

The invention is described next by way of examples with reference to the drawings.

Figure 1:
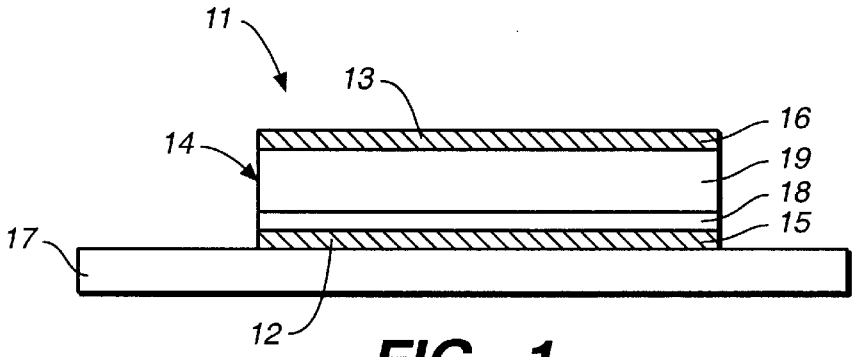
FIG. 1 is a sectional view of a PTC thermistor element embodying this invention and a heating plate to be heated thereby.

FIG. 1 shows a PTC thermistor element 11 embodying the invention, comprising a planar thermistor main body 14 having a pair of mutually oppositely facing first main surface 12 and second main surface 13, a first electrode 15 and a second electrode 16 being formed respectively on the first and second main surfaces 12 and 13 of the thermistor main body 14. When this thermistor element 11 is used as a heating device, a heating plate 17 to be heated thereby and through which a target objected to be heated is positioned as shown so as to contact the first electrode 15. The heating plate 17 may typically comprise a metallic material such as phosphor bronze, stainless steel or an alloy of copper and nickel.

The main body 14 may be circular or polygonal. It is preferable to select a planar shape according to that of the heating plate 17. The thickness of the main body 14 is selected according to official standards as well as the required resistance against applied voltage. The thickness may be about 1.5–2.5 mm if a voltage difference of about 100 V is to be applied.

The main body 14 comprises PTC thermistor materials which may be ceramic or organic materials. If organic thermistor materials are used, a flexible heater can be formed with the thermistor element 11.

If the main body 14 comprises a ceramic material, the electrodes 15 and 16 may be ohmic electrodes comprising silver, aluminum, nickel or their alloys. If the main body 14 is of an organic material, metallic foils such as nickel or copper with a roughened surface are used.

According to the example shown in FIG. 1, the main body 14 is of a layered structure with two layers, the first layer 18 on the side of the first main surface 12 and the second layer 19 on the side of the second main surface 13, the boundary surface therebetween extending parallel to the two main surfaces 12 and 13. The first layer 18 is thinner than the second layer 19 and comprises a PTC thermistor material with a lower Curie temperature.

Figure 2:
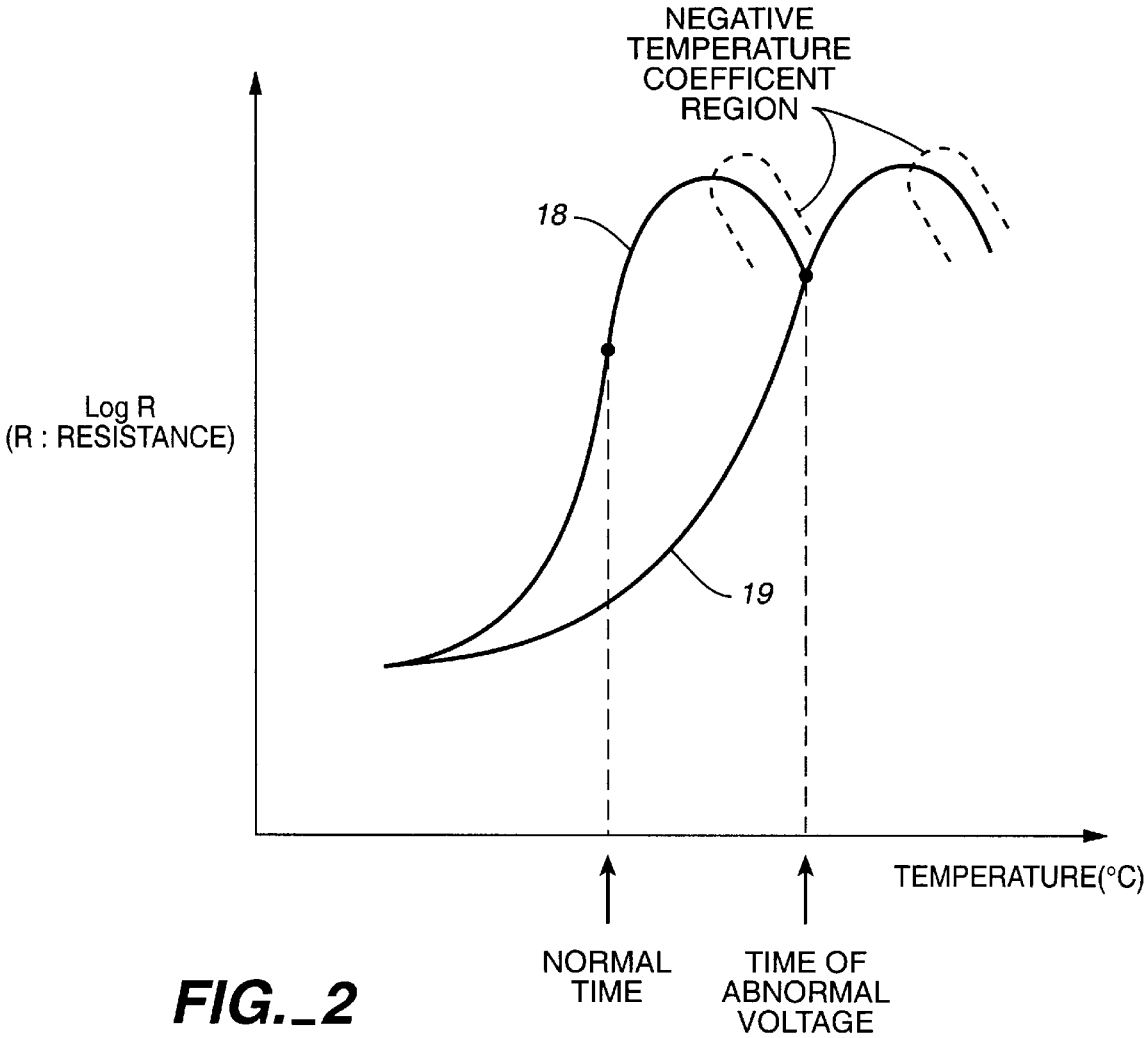
FIG. 2 is a graph showing the relationship between the resistance of the thermistor element of FIG. 1 and temperature for explaining the principle of its operation.

If a voltage difference is applied between the first and second electrodes 15 and 16, the main body 14 begins to generate heat, and the resistance values of the first and second layers 18 and 19 change as shown in FIG. 2. After a specified length of time, as indicated as "Normal Time" in FIG. 1, the resistance of the first layer 18 becomes higher than that of the second layer 19 and hence the fractional share of the applied voltage across the first layer 18 becomes higher than that by the second layer 19. As a result, the center of heat generation inside the main body 14 shifts towards the first main surface 12.

Figure 3:
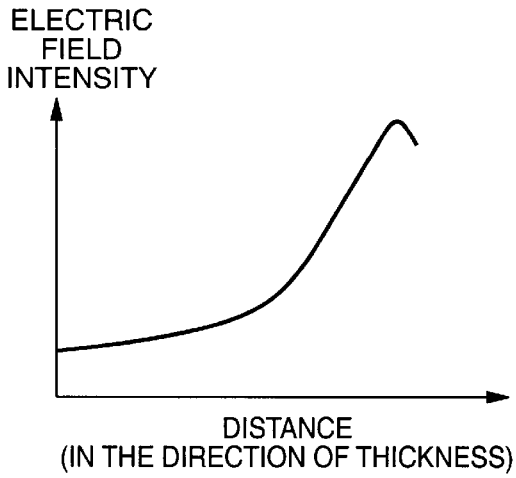
FIG. 3 is a graph showing the distribution of electric field intensity which may result in the direction of thickness of the thermistor element of FIG. 1.
Figure 4:
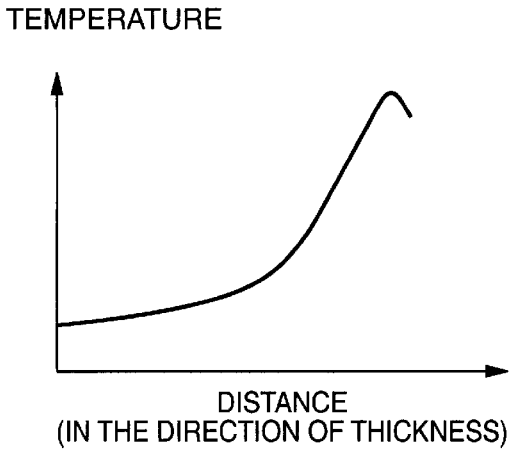
FIG. 4 is a graph showing the temperature distribution which may result in the direction of thickness of the thermistor element of FIG. 1.
Figure 11:
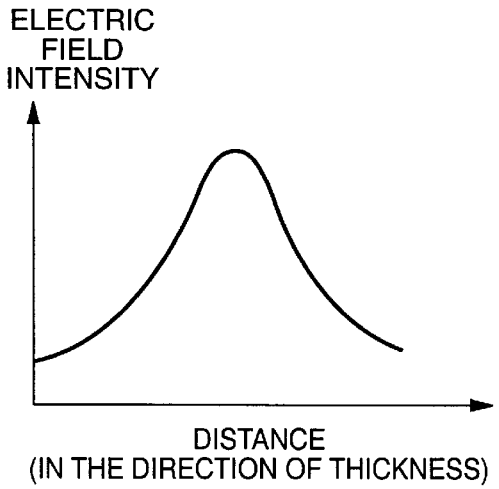
FIG. 11 (PRIOR ART)
FIG. 11 is a graph showing the distribution of electric field intensity which may result in the direction of thickness of the prior art thermistor element of FIG. 9.
Figure 12:
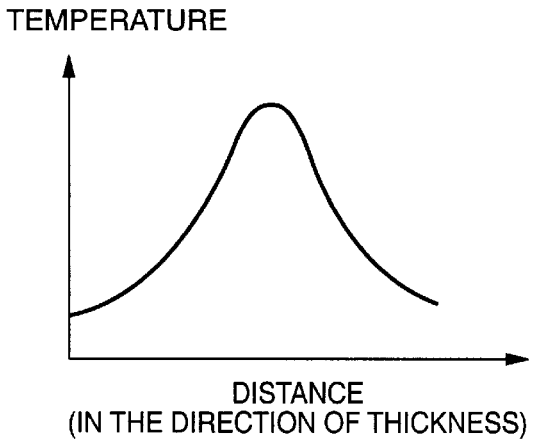
FIG. 12 (PRIOR ART)
FIG. 12 is a graph showing the temperature distribution which may result in the direction of thickness of the prior art thermistor element of FIG. 9.

FIG. 3, like FIG. 11, shows the distribution of electric field intensity which may result in the direction of thickness of the thermistor element 11 of FIG. 1, and FIG. 4, like FIG. 12, shows the temperature distribution which may result likewise. Both in FIGS. 3 and 4, the horizontal axis indicates the distance in the direction of the thickness measured from the second main surface 13 having the second electrode 16 thereon and towards the first main surface 12 with the first electrode 15.

Figure 9:
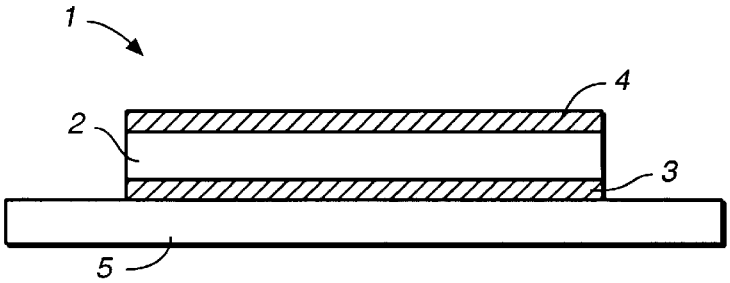
FIG. 9 (PRIOR ART)
FIG. 9 is a sectional view of a prior art PTC thermistor element and a heating plate to be heated thereby.
Figure 10:
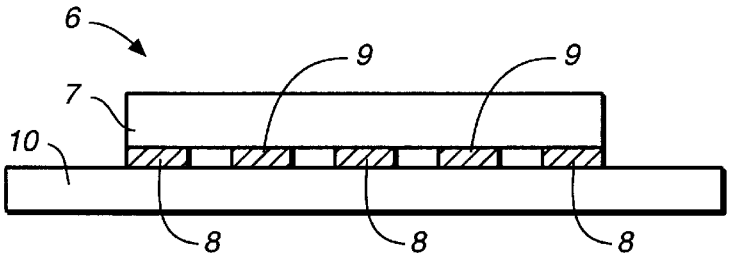
FIG. 10 (PRIOR ART)
FIG. 10 is a sectional view of another prior art PTC thermistor element and a heating plate to be heated thereby.

As explained above, since the center of heat production inside the main body 14 is shifted towards the first main surface 12, the first layer 18 is more intensely heated and the distribution of the electric field intensity is also shifted towards the first electrode 15. Thus, the temperature distribution becomes such that the temperature increases on the side of the first electrode 15, as shown in FIG. 4. The temperature on the side of the first electrode 15 becomes higher than that on the corresponding side of the prior art thermistor element 1 shown in FIG. 9.

In summary, the main body 14 generates heat relatively near the heating plate 17 and the heat can be propagated more quickly and efficiently from the main body 14 to the target object 17.

It is to be noted that the PTC thermistor element 11 has a temperature self-control function. When the temperature of the heating plate 17 goes down, the temperature of the PTC thermistor element 11 also goes down, causing its resistance to go down. This increases the current flowing there through and tends to raise the temperature of the heating plate 17. If the temperature of the heating plate 17 goes up, on the other hand, the temperature of the PTC thermistor element 11 also increases, causing its resistance to go up. This tends to limit the current there through and the temperature of the heating plate 17 goes down. If the center of heat generation is on the side of the first layer 18, as explained above, the temperature of the heating plate 17 can be more easily detected, and the aforementioned temperature self-control function can operate more easily.

If an excessively large voltage is applied to the PTC thermistor element 11, as indicated by "Time of Abnormal Voltage" in FIG. 2, the first layer 18 would come to have a negative temperature coefficient, as indicated by phrase "Negative Temperature Coefficient Region" in FIG. 2, causing a thermorunaway. According to the present invention, since the negative temperature coefficient region of the second layer 19 is at a still higher temperature region, the destruction of the first layer due to thermorunaway can be prevented. As a result, the reliability of the PTC thermistor element 11 is improved.

When the first and second layers 18 and 19 are formed so as to have different Curie temperatures, it is preferred to make this difference greater than 20° C. in order to more reliably bring about the various effects described above.

In order to substantiate the description of various effects and characteristics of the present invention, experiments were carried out by preparing many test samples as follows. With reference to FIG. 1, $BaTiO_3$ materials with Curie temperature 120° C., 130° C., 140° C., 150° C., 160° C., 170° C. and 180° C. were prepared for the first layer 18 and a $BaTiO_3$ material with Curie temperature 180° C. was prepared for the second layer 19. Then, sample thermistor main bodies 14 were obtained by using these materials for the first and second layers 18 and 19 in different combinations and by carrying out various production processes such as sheet molding, layering, press molding, degreasing, and baking. Sample thermistor main bodies 14 thus obtained with the first layer 18 having different Curie temperatures were as shown in Table 1.

Next, ohmic electrodes were formed as the first and second electrodes 15 and 16 on the main surfaces 12 and 13 on each of these sample thermistor main bodies 14 to obtain sample PTC thermistor elements 11.

Finally, an aluminum plate was attached as the heating plate 17 to each of the sample PTC thermistor elements 11 on the side of the first electrode 15. A specified voltage difference was applied between the first and second electrodes 15 and 16, and the coefficient of heat dissipation Ds from each sample PTC thermistor element 11 to the attached heating plate 17 was obtained. The results are also shown in Table 1.

TABLE 1

| Sample No. | Curie Temperature of First Layer (° C.) | Curie Temperature of Second Layer (° C.) | Difference (° C.) | Ds (W/° C.) |
|---|---|---|---|---|
| 1 | 120 | 180 | 60 | 0.671 |
| 2 | 130 | 180 | 50 | 0.664 |
| 3 | 140 | 180 | 40 | 0.651 |
| 4 | 150 | 180 | 30 | 0.617 |
| 5 | 160 | 180 | 20 | 0.565 |
| 6 | 170 | 180 | 10 | 0.288 |
| 7 | 180 | 180 | 0 | 0.273 |

As can be seen by comparing Samples 1–5 with Samples 6 and 7, the coefficient of thermal dispersion Ds becomes significantly greater if the difference between the Curie temperatures of the first and second layers 18 and 19 is greater than 20° C. than if it is less than 20° C. In other words, Samples 1–5 can efficiently propagate heat to the heating plate 17.

From the points of view of efficiency of heat generation and thermal response, as explained above, it is preferred that the thickness of the first layer 18 be less than that of the second layer 19. If the first layer 18 is made too thin, however, its resistance against applied voltage may be adversely affected. In order to eliminate or alleviate this problem, it is preferred that resistance of the first layer 18 immediately after a voltage difference is applied between the electrodes 15 and 16 be less than that of the second layer 19.

Explained more in detail, a voltage division takes place between the first and second layers 18 and 19 when a voltage difference is applied because the first and second layers 18 and 19 have different resistance values. Immediately after the voltage is applied, nearly all of this voltage difference is across the second layer 19 having a larger resistance value. Thus, heat generation is started inside the second layer 19 during this initial period. This generated heat is propagated into the first layer 18, and as the temperature of the first layer 18 is gradually increased and comes close to its Curie temperature, the resistance of the first layer 18 increases rapidly, and nearly all of the applied voltage difference appears across the first layer 18.

Thus, the thicker second layer 19 serves to mostly resist against the applied voltage difference during the initial period immediately after the voltage difference is applied such that the thinner first layer 18 does not experience a large voltage difference. After a certain period of time, almost all of the applied voltage appears across the first layer 18, as explained above, such that the heat can be efficiently propagated from the thermistor main body 14 to the heating plate 17.

In order to ascertain the relationship between the effect of the present invention and the thicknesses of the first and second layers 18 and 19, test experiments were further carried out as follows by preparing more sample thermistor main bodies 14 with the first and second layers 18 and 19 of different thicknesses as shown in FIG. 2 from $BaTiO_3$ materials with Curie temperature 120° C. for the first layer 18 and another $BaTiO_3$ material with Curie temperature 180° C. for the second layer 19 by carrying out, as described above, various production processes such as sheet molding, layering, press molding, degreasing, and baking. Next, ohmic electrodes were formed as the first and second electrodes 15 and 16 on the main surfaces 12 and 13 on each of these sample thermistor main bodies 14 to obtain sample PTC thermistor elements 11, and, finally, an aluminum plate was attached as a heating plate 17 to each of the sample PTC thermistor elements 11 on the side of the first electrode 15. A specified voltage difference was applied between the first and second electrodes 15 and 16, and the coefficient of heat dissipation Ds from each sample PTC thermistor element 11 to the attached heating plate 17 was obtained. The results are also shown in Table 2.

TABLE 2

| Sample No. | Thickness of First Layer (mm) | Thickness of Second Layer (mm) | Ratio | Ds (W/° C.) |
|---|---|---|---|---|
| 8 | 0.0 | 2.0 | 0 | 0.273 |
| 9 | 0.1 | 1.9 | 0.05 | 0.601 |
| 10 | 0.3 | 1.8 | 0.18 | 0.663 |
| 11 | 0.5 | 1.5 | 0.33 | 0.671 |
| 12 | 0.6 | 1.4 | 0.43 | 0.609 |
| 13 | 0.8 | 1.2 | 0.67 | 0.497 |
| 14 | 1.0 | 1.0 | 1.00 | 0.387 |
| 15 | 1.5 | 0.5 | 3.00 | 0.309 |
| 16 | 2.0 | 0.0 | — | 0.242 |

In Table 2, Samples 8 and 16 are to be considered comparison examples, each having a main body of a single-layer structure. Table. 2 clearly shows that Samples 9–15 which embody this invention have much greater coefficients of heat dissipation than Samples 8 and 16 which are comparison examples.

Among Samples 9–15 which embody the present invention, it is noted that the coefficient of heat dissipation increases sequentially from Sample 15 to 14 to 13, etc. as the thickness of the first layer 18 is reduced. It is noted in particular that this coefficient is significantly large for Samples 9–13 with the ratio of thickness between the first layer 18 and the second layer 19 ("Ratio" in Table 2) less than 1, as compared to Samples 14 and 15 with the "Ratio" equal to or greater than 1. This is because the center of heat emission approaches the main surface of the main body 14 on the side of its first layer 18 as the "Ratio" is made smaller.

Table 2 further shows that Samples 9–13 with the "Ratio" in the range of 0.05–0.43 have particularly increased coefficients of heat dissipation. Although no sample with the "Ratio" less than 0.05 has been tested, Table 2 tends to indicate that the coefficient of heat dissipation will be less than 0.601 W/° C. if the "Ratio" is less than 0.05. This is probably because the resistance of the first layer 18 becomes smaller as its thickness is reduced and hence its heat emission rate also becomes smaller.

In view of the above, it may be concluded that the "Ratio" should preferably be within a range of about 0.05–0.43.

Among the coefficient of heat dissipation Ds, the power P supplied to the PTC thermistor element 11, the surface temperature T of the heating plate 17 and the temperature Ts of the thermistor element 11, there is a relationship given by P=Ds(T-Ts). This means that if the coefficient of heat dissipation Ds is increased with the power P remaining at the same level, the temperature difference between the thermistor element 11 and the heating plate 17 becomes smaller, that is, the power P is efficiently being transmitted to the heating plate 17.

Next, Samples 17–21 of PTC thermistor element 11 were prepared by modifying Sample 11 of Table 2 (with a first layer 18 having Curie temperature 120° C. and thickness 0.5 mm and a second layer 19 having Curie temperature 180° C. and thickness 1.5 mm) such that the first and second layers 18 and 19 of their thermistor main body 14 have different resistance values. Table 3 shows the fractions of the resistance values of the first and second layers 18 and 19 with respect to the total resistance of each sample thermistor element.

TABLE 3

| Sample No. | Fraction of Resistance Value of First Layer | Fraction of Resistance Value of Second Layer |
|---|---|---|
| 17 | 0.1 | 0.9 |
| 18 | 0.2 | 0.8 |
| 19 | 0.3 | 0.7 |
| 20 | 0.4 | 0.6 |
| 21 | 0.5 | 0.5 |

Figure 5:
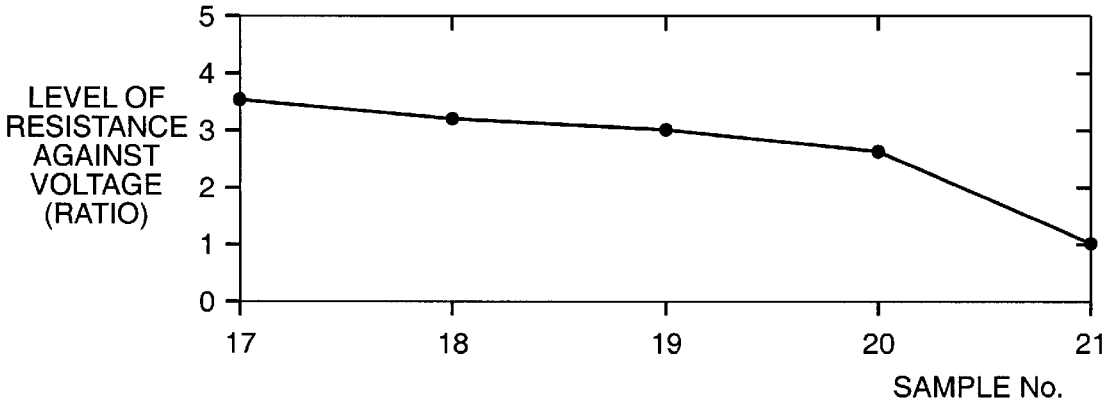
FIG. 5 is a graph showing the results of instantaneous voltage resistance tests carried out on sample PTC thermistor elements embodying this invention.

Each of the samples in Table 3 was subjected to an instantaneous voltage resistance test whereby a voltage was applied directly in a circuit without any load to determine the voltage at which the sample would break. The results of the test are shown in FIG. 5 in which the instantaneous voltage resistance level of each sample in Table 3 is shown as a ratio with that of Sample 21 with the first and second layers having the same resistance. Table 3 and FIG. 5 show that the instantaneous voltage resistance level is high for Samples 17–20 for which the first layer 18 has smaller resistance than the second layer 19. Among Samples 17–20, it is noted that the instantaneous voltage resistance level improves in the order of Samples 20, 19, 18 and 17 as the resistance of the first layer 18 relative to that of the second layer 19 becomes smaller.

Figure 6:
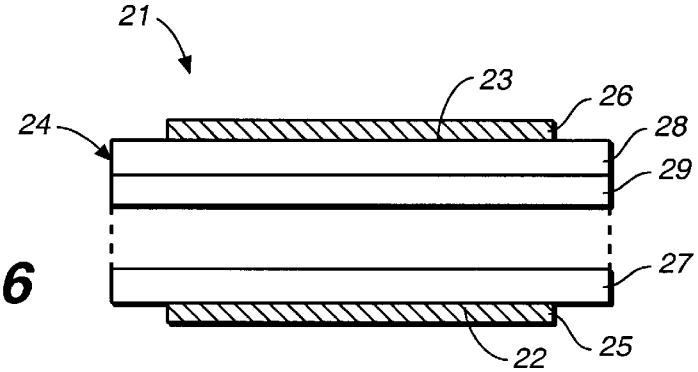
FIG. 6 is a sectional view of another PTC thermistor element according to another embodiment of the invention.

FIG. 6 shows another PTC thermistor element 21 according to another embodying of this invention which is similar to the thermistor element 11 described above with reference to FIG. 1 wherein it comprises a thermistor main body 24 having a pair of mutually oppositely facing first and second main surfaces 22 and 23 and a pair of first and second electrodes 25 and 26 formed respectively on the first and second main surfaces 22 and 23 and is characterized wherein the thermistor main body 24 is of a layered structure with three or more layers extending parallel to its main surfaces 22 and 23. As shown in FIG. 6, the layered structure includes a first outer layer 27 on the side of the first main surface 22, a second outer layer 28 on the side of the second main surface 23 and one or more inner layers 29 therebetween. At least one of the outer layers 27 and 28 is made of a PTC thermistor material with a lower Curie temperature than the inner layer or layers 29. Experiments have shown it to be preferable that the thickness of at least one of the outer layers 27 and 28 is 0.05–0.43 times that of the inner layer or layers 29 and that the Curie temperature of at least one of the outer layers 27 and 28 is lower than that of the inner layer or layers 29 by more than 20° C.

With reference still to FIG. 6, if the first outer layer 27 is made of a PTC thermistor material with a Curie temperature lower than those of both the second outer layer 28 and the inner layer or layers 29, a heating plate to be heated (not shown in FIG. 6) is disposed in the direction faced by the first electrode 25, and it is preferred that the first outer layer 27 be made thinner than the second outer layer 28 and the inner layer or layers 29 and that the first outer layer 27 be made to have a smaller resistance value than the other layers 28 and 29 immediately after a voltage difference is applied between the electrodes 25 and 26. If both the first and second outer layers 27 and 28 are made of a PTC thermistor material with a Curie temperature lower than that of the inner layer or layers 29, heating plates to be heated may be disposed each in the direction faced by a different one of the electrodes 25 and 26, and it is preferred that both outer layers 27 and 28 be made thinner than the inner layer or layers 29 and have a resistance value lower than that of the inner layer or layers 29 immediately after a voltage difference is applied between the electrodes 25 and 26.

Although the invention has been described above with reference to only a small number of embodiments, these illustrated examples are not intended to limit the scope of the invention. Many modifications and variations are possible within the scope of this invention. If the layer at the first main surface of the thermistor main body (or the first outer layer) is made of a PTC thermistor material such that the voltage difference across the first outer layer is the largest among the voltage differences across the other layers when a voltage difference has been applied to the thermistor element for a specified length of time, for example, the other layers may be formed with an ordinary resistor material or an NTC thermistor material with a negative temperature coefficient.

In summary, PTC thermistor elements according to this invention is characterized as having the center of heat production inside the thermistor main body shifted to the neighborhood of one of its main surfaces. Thus, if a heating device is formed with such a PTC thermistor element and a heating plate to be heated is placed in the direction faced by the electrode formed on this main surface, heat can be transmitted more effectively to the heating plate even if the size of the device is not increased or the thickness of the thermistor main body is not reduced, say, beyond an officially standardized minimum thickness.

Figure 7A:
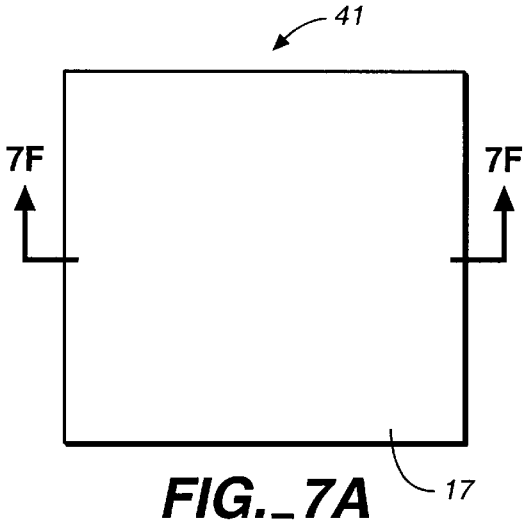
FIGS. 7A, 7B, 7C, 7D, 7E and 7F show a heating device incorporating a PTC thermistor element as shown in FIG. 1, FIG. 7A being its top view, FIG. 7B being its bottom view, FIG. 7C being its right-hand side view, FIG. 7D being its front view, FIG. 7E being its left-hand side view, and FIG. 7F being a sectional view taken along line 7F—7F of FIG. 7A.
Figure 7C:
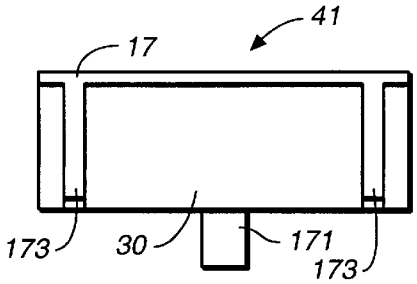
Figure 7D:
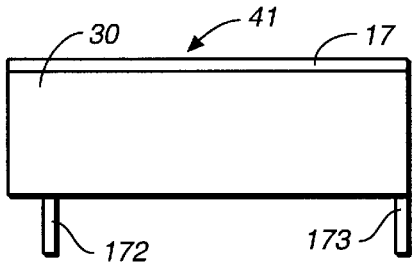
Figure 7B:
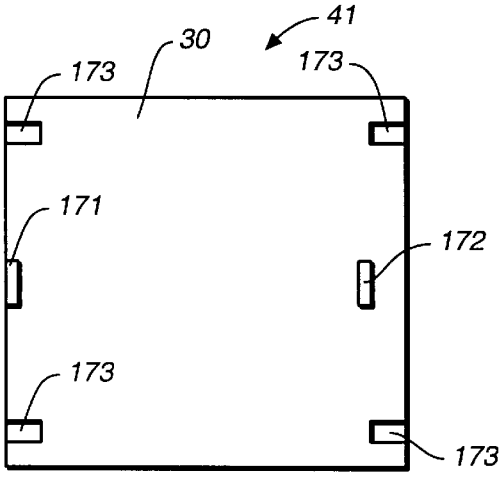
Figure 7E:
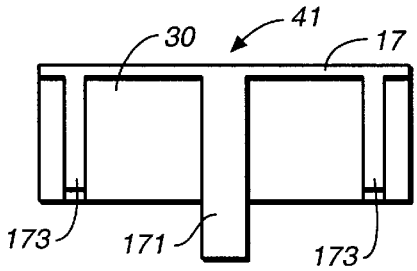
Figure 7F:
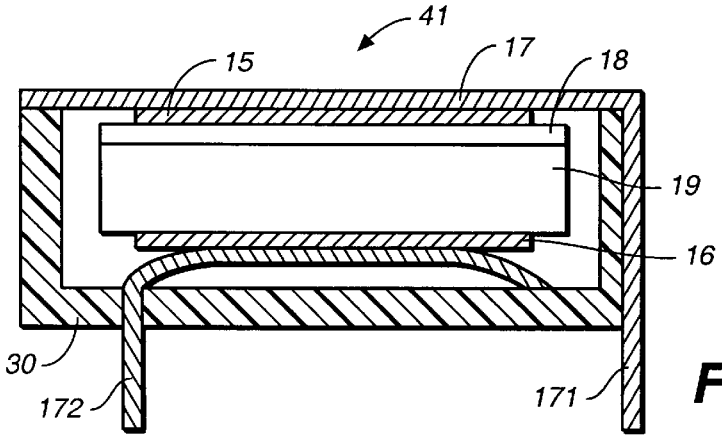

Next, heating devices incorporating PTC thermistor elements embodying this invention will be described by way of examples. FIGS. 7A, 7B, 7C, 7D, 7E and 7F show such a heating device 41 formed by enclosing a PTC thermistor element as shown in FIG. 1 (and hence having its components indicated by the same numerals as in FIG. 1) inside a box-shaped case 30 with a bottom and side walls. The case 30 is made of an electrically insulating material having a high resistance against heat such as alumina, phenol resin and polyphenylene sulfide resin. The heating plate 17 covers the top surface of this box-shaped case 30, having a terminal 171 extending therefrom along one of the side walls of the case 30 as well as a plurality of other protruding members 173 extending therefrom along side walls of the case 30 as shown in FIGS. 7B, 7C and 7E in particular so as to hug the case and to thereby attach the heating plate 17 at the top of the case 30. Another terminal 172, made of a metallic material similar to the heating plate 17 such as phosphor bronze, stainless steel or an alloy of copper and nickel and being elastic, is provided, penetrating the bottom of the case 30 and not only contacts the second electrode 16 of the enclosed thermistor element but also serves to press the first electrode 15 against the heating plate 17 such that the heat generated by the thermistor element will be transmitted effectively to the heating plate 17.

Figure 8A:
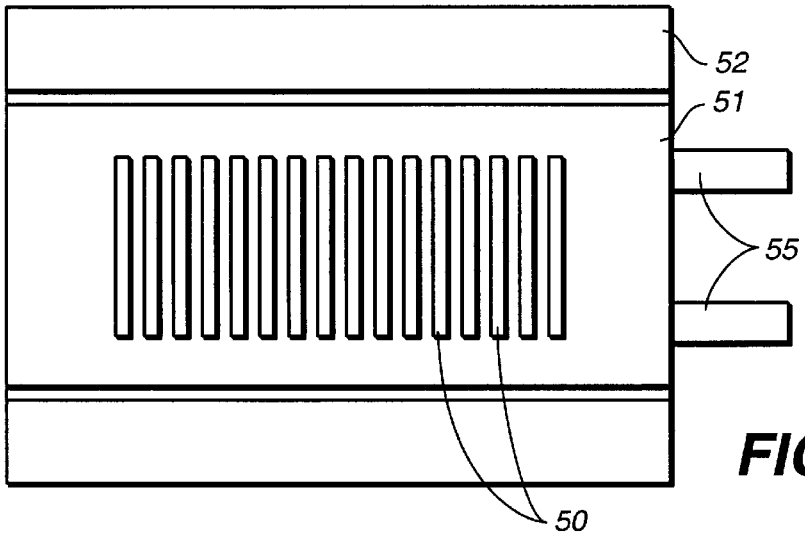
FIGS. 8A, 8B, 8C and 8D show another heating device of this invention incorporating a PTC thermistor element as shown in FIG. 6, FIG. 8A being its top view, FIG. 8B being its side view, FIG. 8C being its sectional view taken along line 8C—8C of FIG. 8B.
Figure 8B:
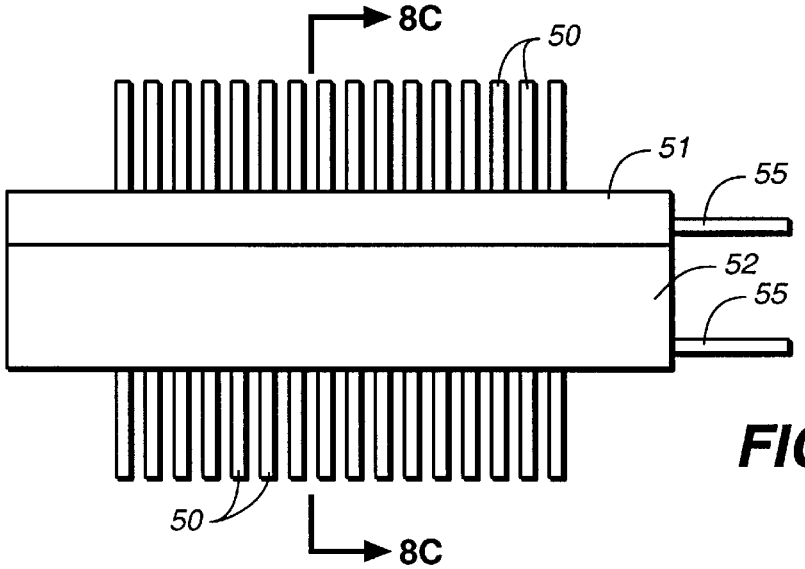
Figure 8C:
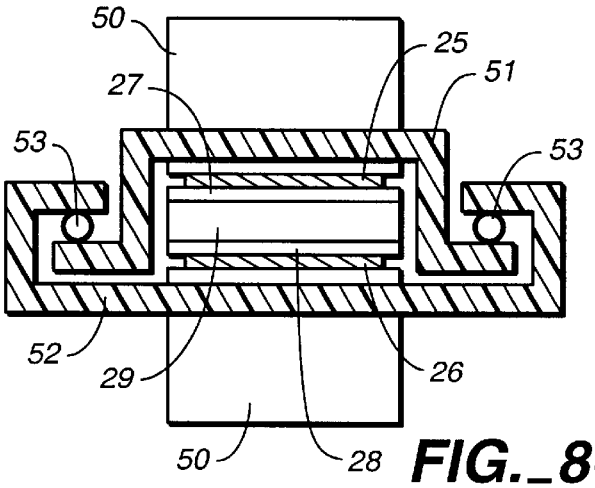
Figure 8D:
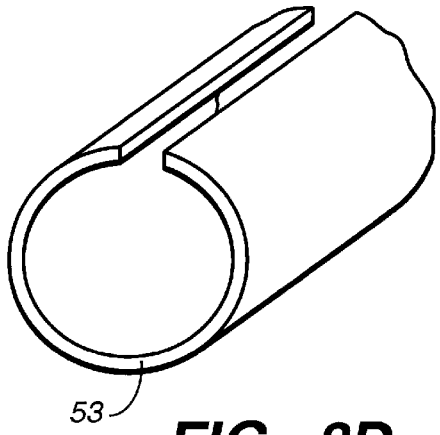

Another example of heating device of this invention incorporating a PTC thermistor element formed as shown in FIG. 6 (and hence having its components indicated by the same numerals as in FIG. 6) is described next with reference to FIGS. 8A, 8B, 8C and 8D. The thermistor element composed of a first electrode 25 and a second electrode 26 sandwiching therebetween a thermistor main body of a layered structure with outer layers 27 and 28 and one or more inner layers 29 is enclosed between an upper case member 51 and a lower case member 52 both made of an electrically insulating material like the case 30 described above with reference to FIGS. 7A–7F. The upper and lower case members 51 and 52 are each penetrated by a plurality of heat radiating fins 50 made of aluminum connected to terminal electrodes 55. The upper and lower case members 51 and 52 each have flange parts which overlap and have elastic members 53 inserted in between such that the elastic force of these elastic members 53 tends to compress the heat radiating fins 50 through the upper case member 51 against the first electrode 25 and the heat radiating fins 50 through the lower case member 52 against the second electrode 26 such that the heat generated inside the thermistor main body can be effectively transmitted to the fins 50 and radiated therefrom. The elastic members 53 may, for example, be in the form of a slitted hollow tube, as shown in FIG. 8D. The heating device thus structured may be used as a source of a heated air current.

Although only two examples of heating device are described herein with illustrations but they are not intended to limit the scope of the invention. A thermistor element of the type shown in FIG. 1 may be enclosed inside case members as shown in FIGS. 8A–8D, and a thermistor element of the type shown in FIG. 6 may be enclosed inside a case as shown in FIGS. 7A–7F although such examples are not separately illustrated. The disclosure is intended to be interpreted broadly and all such modifications and variations that are apparent to a person skilled in the art are intended to be within the scope of the invention.

What is claimed is:

1. A PTC thermistor element comprising:

a main body having a first main surface and a second main surface which face mutually oppositely away from each other;

a first electrode on said first main surface; and a second electrode on said second main surface; said main body comprising PTC thermistor materials and having a layered structure consisting of a first layer including said first main surface and a second layer including said second main surface, said first layer having a thickness 0.05–0.43 times that of said second layer, said first layer having a Curie temperature which is lower than that of said second layer by 20° C. or more.

2. The PTC thermistor element of claim 1 wherein said first layer has a lower resistance value than said second layer immediately after a voltage difference is applied between said first electrode and said second electrode.

3. A PTC thermistor element comprising:

a main body having a first main surface and a second main surface which face mutually oppositely away from each other;

a first electrode on said first main surface; and a second electrode on said second main surface; said main body comprising PTC thermistor materials and having a layered structure consisting of two outer layers and one or more inner layers extending parallel to said first main surface and said second surface between said two outer layers, said two outer layers consisting of a first outer layer including said first main surface and a second outer layer including said second main surface, at least one of said two outer layers having a thickness 0.05–0.43 times that of said one or more inner layers, at least one of said two outer layers having a Curie temperature which is lower than that of said one or more inner layers by 20° C. or more.

4. The PTC thermistor element of claim 3 wherein at least one of said outer layers has a lower resistance value than said one or more inner layers immediately after a voltage difference is applied between said first electrode and said second electrode.

5. The PTC thermistor element of claim 4 wherein said first outer layer has a lower resistance value than said second outer layer and said one or more inner layers immediately after a voltage difference is applied between said first electrode and said second electrode.

6. The PTC thermistor element of claim 5 wherein each of said two outer layers has a lower resistance value than said one or more inner layers immediately after a voltage difference is applied between said first electrode and said second electrode.

7. The PTC thermistor element of claim 5 wherein said first outer layer is made of a PTC thermistor material with a Curie temperature which is the lowest among Curie temperatures of materials of said outer layers and said one or more inner layers.

8. The PTC thermistor element of claim 6 wherein said first outer layer is the thinnest among said two outer layers and said one or more inner layers.

9. The PTC thermistor element of claim 8 wherein each of said two outer layers is made of a PTC thermistor material with a Curie temperature lower than that of said one or more inner layers.

10. The PTC thermistor element of claim 7 wherein each of said two outer layers is thinner than said one or more inner layers.

11. A heating device comprising a PTC thermistor element and a metallic heating plate, said PTC thermistor element comprising:

a main body having a first main surface and a second main surface which face mutually oppositely away from each other;

a first electrode on said first main surface, said metallic heating plate contacting said first electrode; and a second electrode on said second main surface; said main body comprising PTC thermistor materials and having a layered structure consisting of a first layer including said first main surface and a second layer including said second main surface, said first layer having a thickness 0.05–0.43 times that of said second layer, said first layer having a Curie temperature which is lower than that of said second layer by 20° C. or more.

12. The heating device of claim 11 wherein said first layer has a lower resistance value than said second layer immediately after a voltage difference is applied between said first electrode and said second electrode.

13. A heating device comprising a PTC thermistor element and a metallic heating plate, said PTC thermistor element comprising:

a main body having a first main surface and a second main surface which face mutually oppositely away from each other;

a first electrode on said first main surface, said metallic heating plate contacting said first electrode; and a second electrode on said second main surface; said main body comprising PTC thermistor materials and having a layered structure consisting of two outer layers and one or more inner layers extending parallel to said first main surface and said second surface between said two outer layers, said two outer layers consisting of a first outer layer including said first main surface and a second outer layer including said second main surface, at least one of said two outer layers having a thickness 0.05–0.43 times that of said one or more inner layers, at least one of said two outer layers having a Curie temperature which is lower than that of said one or more inner layers by 20° C. or more.

14. The heating device of claim 13 wherein at least one of said outer layers has a lower resistance value than said one or more inner layers immediately after a voltage difference is applied between said first electrode and said second electrode.

15. The heating device of claim 14 wherein said first outer layer has a lower resistance value than said second outer layer and said one or more inner layers immediately after a voltage difference is applied between said first electrode and said second electrode.

16. The heating device of claim 15 wherein each of said two outer layers has a lower resistance value than said one or more inner layers immediately after a voltage difference is applied between said first electrode and said second electrode.

17. The heating device of claim 16 wherein said first outer layer is made of a PTC thermistor material with a Curie temperature which is the lowest among Curie temperatures of materials of said outer layers and said one or more inner layers.

18. The heating device of claim 16 wherein said first outer layer is the thinnest among said two outer layers and said one or more inner layers.

19. The heating device of claim 17 wherein each of said two outer layers is made of a PTC thermistor material with a Curie temperature lower than that of said one or more inner layers.

20. The heating device of claim 19 wherein each of said two outer layers is thinner than said one or more inner layers.

21. A heating device comprising a PTC thermistor element and metallic heating plates, said PTC thermistor element comprising:

a main body having a first main surface and a second main surface which face mutually oppositely away from each other;

a first electrode on said first main surface, at least one of said metallic heating plates contacting said first electrode; and a second electrode on said second main surface, at least one of said metallic heating plates contacting said second electrode, said main body comprising PTC thermistor materials and having a layered structure consisting of two outer layers and one or more inner layers extending parallel to said first main surface and said second surface between said two outer layers, said two outer layers consisting of a first outer layer including said first main surface and a second outer layer including said second main surface, at least one of said two outer layers having a thickness 0.05–0.43 times that of said one or more inner layers, at least one of said two outer layers having a Curie temperature which is lower than that of said one or more inner layers by 20° C. or more.

22. The heating device of claim 21 wherein at least one of said outer layers has a lower resistance value than said one or more inner layers immediately after a voltage difference is applied between said first electrode and said second electrode.

23. The heating device of claim 22 wherein each of said two outer layers has a lower resistance value than said one or more inner layers immediately after a voltage difference is applied between said first electrode and said second electrode.

24. The heating device of claim 23 wherein each of said two outer layers is made of a PTC thermistor material a Curie temperature lower than that of said one or more inner layers.

25. The heating device of claim 24 wherein each of said two outer layers is thinner than said one or more inner layers.

* * * * *